US008047970B2

(12) United States Patent
Nalley

(10) Patent No.: US 8,047,970 B2
(45) Date of Patent: Nov. 1, 2011

(54) WEIGHT PLATE WITH DETACHABLE LOCKING CARTRIDGE

(76) Inventor: Mark Nalley, Murrieta, CA (US)

( * ) Notice: Subject to any disclaimer, the term of this patent is extended or adjusted under 35 U.S.C. 154(b) by 372 days.

(21) Appl. No.: 12/217,743

(22) Filed: Jul. 9, 2008

(65) Prior Publication Data

US 2010/0009819 A1 Jan. 14, 2010

(51) Int. Cl.
*A63B 21/08* (2006.01)
*A63B 21/062* (2006.01)
*A63B 21/072* (2006.01)

(52) U.S. Cl. ..... 482/98; 482/97; 482/100; 482/107

(58) Field of Classification Search ..... 482/98, 482/92–97, 107
See application file for complete search history.

(56) References Cited

U.S. PATENT DOCUMENTS

| | | | | | |
|---|---|---|---|---|---|
| 772,906 | A * | 10/1904 | Reach | 482/98 |
| 848,272 | A * | 3/1907 | Thornley | 482/102 |
| 1,052,962 | A * | 2/1913 | Reach | 482/102 |
| 1,053,109 | A * | 2/1913 | Reach | 482/99 |
| 1,752,412 | A * | 4/1930 | Blickman | 482/90 |
| 2,632,645 | A * | 3/1953 | Barkschat | 482/38 |
| 3,614,097 | A * | 10/1971 | Blickman | 482/72 |
| 4,529,198 | A * | 7/1985 | Hettick, Jr. | 482/104 |
| 5,102,124 | A * | 4/1992 | Diodati | 482/107 |
| 5,123,885 | A * | 6/1992 | Shields | 482/106 |
| 5,306,221 | A * | 4/1994 | Itaru | 482/98 |
| 5,350,344 | A * | 9/1994 | Kissel | 482/98 |
| 5,605,523 | A * | 2/1997 | Ish et al. | 482/99 |
| 5,641,147 | A * | 6/1997 | Pena | 473/552 |
| 5,897,444 | A * | 4/1999 | Hellyer | 473/417 |
| 6,482,135 | B1 * | 11/2002 | Ish et al. | 482/97 |
| D519,173 | S * | 4/2006 | Nalley | D21/680 |
| 7,060,010 | B2 * | 6/2006 | Daniel | 482/94 |
| 7,179,208 | B1 * | 2/2007 | Nalley | 482/99 |
| 7,335,139 | B2 * | 2/2008 | Bartholomew et al. | 482/97 |
| 7,413,532 | B1 * | 8/2008 | Monsrud et al. | 482/99 |
| 7,413,533 | B2 * | 8/2008 | Lin | 482/108 |
| 7,588,520 | B2 * | 9/2009 | Nalley | 482/107 |
| 7,608,021 | B1 * | 10/2009 | Nalley | 482/98 |
| 7,614,981 | B2 * | 11/2009 | Cao | 482/98 |
| 7,758,478 | B2 * | 7/2010 | Golesh et al. | 482/98 |
| 2005/0075221 | A1 * | 4/2005 | Fond | 482/93 |
| 2005/0272561 | A1 * | 12/2005 | Cammerata | 482/8 |
| 2007/0004569 | A1 * | 1/2007 | Cao | 482/94 |
| 2007/0243976 | A1 * | 10/2007 | Cao | 482/94 |
| 2008/0242520 | A1 * | 10/2008 | Hubbard | 482/98 |
| 2008/0305936 | A1 * | 12/2008 | Cao | 482/98 |
| 2010/0285933 | A1 * | 11/2010 | Nalley | 482/94 |

* cited by examiner

*Primary Examiner* — Rinaldi I Rada
*Assistant Examiner* — Robert F Long
(74) *Attorney, Agent, or Firm* — Brown IP Law LC; Kerry W. Brown

(57) ABSTRACT

A weight plate having a detachable locking cartridge by which the weight plate is releasably connected to a lifting element (e.g., a center post) whereby one or more weight plates carried by the lifting element may be lifted by a user. The weight plate also has a plate body with a central bore in which to receive the lifting element. In one embodiment, the detachable locking cartridge is mounted flush against one side (e.g., the bottom) of the weight plate body so as to lie entirely external to the plate body. In an alternate embodiment, the detachable locking cartridge includes a stabilizer extension that is received within a cavity recessed in the one side of the plate body. The detachable locking cartridge includes a manually-accessible toggle lever switch arm that is adapted to rotate within a housing of the cartridge between locked and unlocked positions to thereby control the displacement of a locking pin relative to the lifting element within the central bore of the plate body.

12 Claims, 5 Drawing Sheets

WEIGHT PLATE WITH DETACHABLE LOCKING CARTRIDGE

BACKGROUND OF THE INVENTION

1. Field of the Invention

This invention relates to a weight plate of the kind common to physical fitness weight lifting equipment to be coupled to a lifting element (e.g., a center post) of such equipment and lifted during a body building exercise. The weight plate includes a detachable locking cartridge having a manually-controlled locking pin that slides reciprocally through the plate body so that the weight plate can be either positively attached to or separated from the lifting element.

2. Background Art

My co-pending patent application Ser. No. 11/349,101 filed Feb. 8, 2006 discloses a weight plate that is associated with weight lifting equipment by which the weight plate or a stack of weight plates can be lifted during a body building exercise. This weight plate includes a plate body and a locking cartridge connected to the plate body. The displacement of a locking pin through the weight plate body is controlled by a manually-accessible toggle lever arm that is located within the locking cartridge and coupled to the locking pin. When the toggle lever arm is rotated to an on or locked position, the locking pin is correspondingly caused to slide in a first direction through the plate body to engage a connection union mounted in an adjacent weight plate. When the toggle lever arm is rotated to an off or unlocked position, the locking in is caused to slide in an opposite direction through the plate body to be disengaged from the connection union.

It would be advantageous to be able to detachably connect the locking cartridge to the plate body of a weight plate. In this manner, the locking cartridge can be attached to a conventional plate body so that the weight plate can be selectively and reliably attached to a lifting element of the weight lifting equipment so as to be lifted with a stack of similarly-attached weight plates during a body building exercise.

SUMMARY OF THE INVENTION

In general terms, a weight plate is disclosed that is common to certain physical fitness weight lifting equipment in which one or a stack of weight plates are lifted during a body building exercise. The weight plate includes a plate body having a central bore and a pair of side bores formed therethrough. The central bore through the plate body is sized to receive a lifting element (e.g., the center post) from the weight lifting equipment, and the side bores are sized to receive respective stabilizing guide bars from the equipment.

In accordance with the present improvement, a locking cartridge is detachably connected to the plate body so that the weight plate can be releasably attached to the lifting element of the weight lifting equipment. The center post is tied to a cable to which a pulling force is applied to cause the lifting element and the weight plates carried thereby to be lifted during the body building exercise. In a first preferred embodiment, the detachable locking cartridge is mounted against one side of the plate body so as to lie entirely external to the plate body. In an alternate preferred embodiment, the detachable locking cartridge is removably received within an internal cavity formed in one side of the plate body. In this regard, a pair of fasteners (e.g., screws) extend through the detachable locking cartridge by which the locking cartridge may be removably connected to the plate body. An anchor stud projecting from the locking cartridge is received in an opposing stud hole formed in the plate body to prevent the locking cartridge from sliding over the plate body. Thus, the detachable locking cartridge can be connected to a conventional plate body to enable the weight plate to be attached to the lifting element.

To this end, the locking cartridge includes a housing and a manually-operated toggle lever switch arm that is adapted to rotate within the housing between on and off positions. A locking pin is slidable reciprocally through a locking channel of the locking cartridge and an axially-aligned guide channel of the plate body so as to be displaced relative to the center hole of the plate body. The locking pin is disposed in perpendicular alignment with the side of the plate body to which the locking cartridge is detachably connected. One end of the toggle lever switch arm is manually accessible outside the housing of the locking cartridge to receive a rotational force applied by a user, and the opposite end of the switch arm is coupled to the locking pin so that a rotation of the switch arm results in a linear displacement of the locking pin relative to the center hole of the plate body. More particularly, when the toggle lever switch arm is rotated to the on position, the locking pin is correspondingly displaced in a first direction through the locking and guide channels so as to slide into the center hole in the plate body at which to be attached to the lifting element of the weight lifting apparatus. When the switch arm is rotated to the off position, the locking pin is displaced in an opposite direction so as to slide out of the center hole to be detached from the lifting element.

DESCRIPTION OF THE PREFERRED EMBODIMENT

Figure 1:
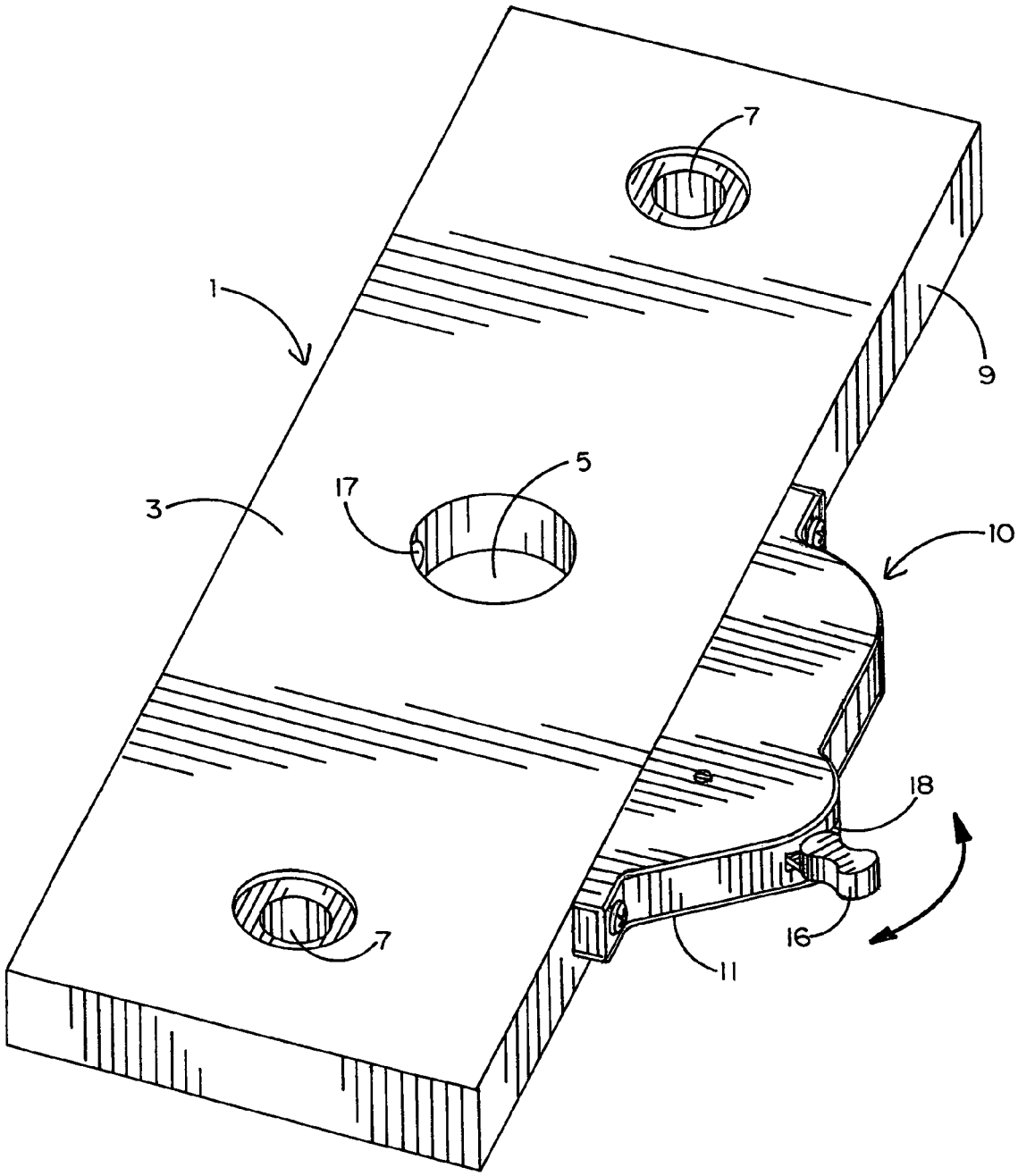
FIG. 1 shows an external locking cartridge according to a first preferred embodiment of this invention detachably connected to one side of a weight plate that is common to certain physical fitness weight lifting equipment.

Referring initially to FIGS. 1-4 of the drawings, there is shown a modified weight plate 1 that can be used in combination with or in place of the weight plate described in my co-pending patent application Ser. No. 11/349,101. Like my previously-described weight plate, the modified weight plate 1 herein disclosed includes a rectangular plate body 3 with a (e.g., 1½ inch diameter) central bore 5 running therethrough and a side bore 7 located adjacent each side of the central bore 5. The weight plate 1 is typically cast from iron, steel, urethane, rubber, plastic or a suitable composite material and is preferably about ten inches long, four inches wide and one inch thick. It is contemplated that the weight plate 1 will be manufactured in five- and 10-pound units. However, it is to be understood that the aforementioned materials and dimensions are for the purpose of example only and should not be regarded as limitations of this invention.

The central bore 5 through the body 3 of weight plate 1 is sized to receive therethrough a lifting element (e.g., a center post designated 34 in FIGS. 3 and 4) that is common to some weight lifting equipment by which a stack of weight plates carried by the lifting element is raised. The side bores 7 through plate body 3 are sized to receive respective guide bars (not shown) to stabilize and prevent rotation of the stack of weight plates positioned one above the other and carried by the lifting element during body building exercises. Because the receipt of the central and side bores 5 and 7 of weight plate 1 by a lifting element and guide bars as just described is known to those in the body building art, no further description thereof will be presented.

Lying entirely outside and lying flush against one side (e.g., the bottom) 9 of the plate body 3 is an external locking cartridge 10. Fasteners (e.g., facial screws) 8 extend through opposite ends of a housing 11 of the external locking cartridge 10 whereby the cartridge is detachably connected to the side 9 of the plate body 3. Thus, an independent external locking cartridge 10 can be connected to a conventional weight plate commonly used during body building exercises to obtain the benefits of this invention. In this same regard, by removing fasteners 8, the external locking cartridge 10 may be advantageously removed and replaced when necessary. An anchor stud 12 projects downwardly from approximately the middle of the housing 11 of locking cartridge 10 for receipt by an opposing locating hole that is formed in the side 9 of the plate body 3. By virtue of the anchor stud 12, the external locking cartridge 10 will be automatically positioned against side 9 to facilitate the reciprocal sliding displacement of an internal (e.g., steel) locking pin 14 through each of the locking cartridge 10 and the weight plate body 3 for a purpose that will soon be described. Moreover, the anchor stud 12 prevents the locking cartridge 10 from shifting along the side 9 to which it is connected.

Figure 2:
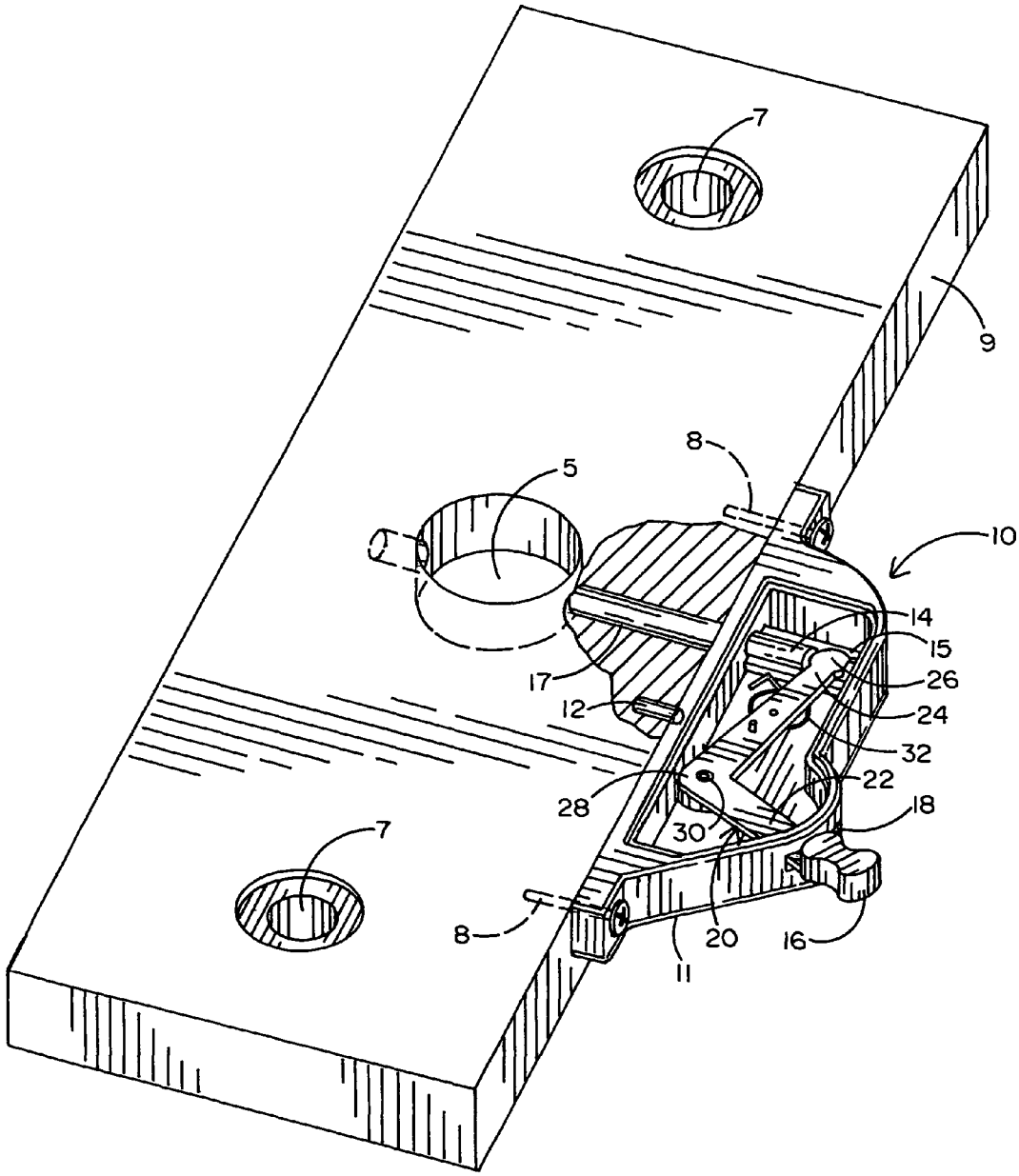
FIG. 2 shows a rotatable toggle lever switch arm of the external locking cartridge of FIG. 1 coupled to a locking pin that is slidable through the plate body depending upon a rotation of the switch arm.

More particularly, the internal locking pin 14 is slidable relative to the central bore 5 in plate body 3 so as to be displaced through a locking channel 15 in the housing 11 of locking cartridge 10 and an axially-aligned guide channel 17 in plate body 3. As best shown in FIG. 2, the locking pin 14 is disposed in perpendicular alignment with the side 9 of plate body 3 so as to be capable of reciprocal movement through the axially-aligned locking channel 15 and guide channel 17. The reciprocal displacement of the locking pin 14 through the locking and guide channels 15 and 17 is selectively controlled by a manually-accessible switch control knob 16 that is manipulated (i.e., rotated) back and forth (in the direction indicated by the reference arrows of FIG. 1) through a guide slot 18 extending through the top of locking cartridge housing 11. The switch control knob 16 is coupled to the locking pin 14 by means of a rotatable (e.g., steel) toggle lever switch arm 20 located within housing 11 so that a rotational force applied to the control knob 16 is converted to a linear displacement of the locking pin 14 relative to the central bore 5 of plate body 3.

The rotatable toggle lever switch arm 20 inside locking cartridge housing 11 includes upper and lower arm members 22 and 24 that are aligned with one another to make an angle of approximately 90 degrees. One end of the upper arm member 22 of toggle lever switch arm 20 extends through the guide slot 18 in the locking cartridge 10 to be attached to the manually-accessible switch control knob 16. One end of the lower arm member 24 of switch arm 20 includes a relatively wide switch head 26 that is positioned in and captured by a bore 27 that is formed near the top of the locking pin 14, whereby a rotation of the switch control knob 16 results in a linear displacement of the locking pin 14 relative to the central bore 5 of plate body 3. The adjacent opposite ends of the upper and lower arm members 22 and 24 of lever arm 20 are coextensively joined to one another at an elbow 28. A swage pin 30 runs laterally through the housing 11 of locking cartridge 10 and the elbow 28 to establish a pivot axis around which the toggle lever switch arm 20 will rotate in response to a rotational force applied by a user to the control knob 16.

Figure 3:
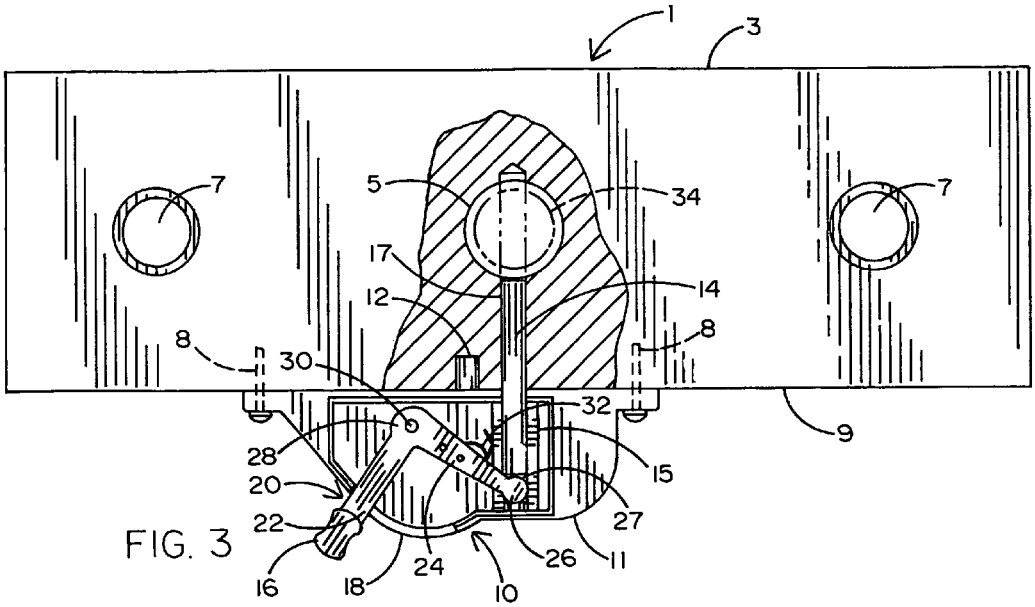
FIG. 3 shows the toggle lever switch arm rotated to an off position for causing the locking pin of the detachable locking cartridge to slide through the weight plate body and out of a central bore formed therein.
Figure 4:
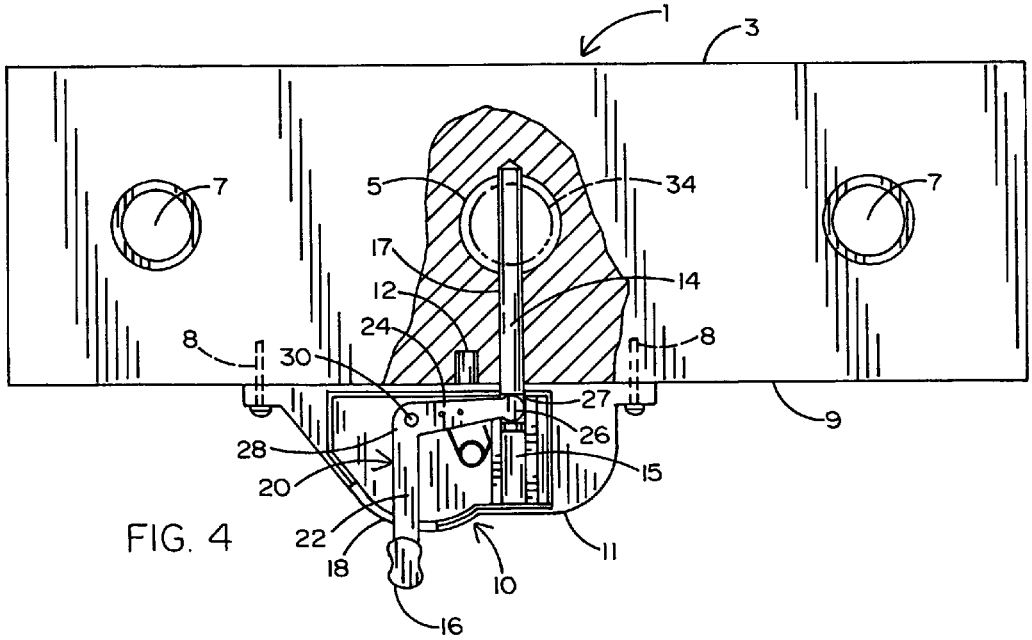
FIG. 4 shows the toggle lever switch arm rotated to an on position for causing the locking pin of the detachable locking cartridge to slide through the weight plate body and into the central bore thereof.

In operation, the switch control knob 16 can be manually manipulated (i.e., rotated) between an unlocked position (of FIG. 3) and a locked position (of FIG. 4). As the switch control knob 16 is manipulated, the upper arm member 22 of toggle lever switch arm 20 is correspondingly rotated through the guide slot 18 at the top of the locking cartridge housing 11. The lower arm member 24 which is coupled to the internal locking pin 14 by receipt of switch head 26 at bore 27 rotates with the upper arm member 22. That is, the switch arm 20 will rotate within the housing 11 of locking cartridge 10 around the swage pin 30 running through elbow 28 as the control knob 16 is manipulated between the aforementioned locked and unlocked positions.

In particular, with the switch control knob 16 rotated to the unlocked position of FIG. 3, the locking pin 14 is pulled in a first direction by the toggle lever switch arm 20 outwardly from the central bore 5 of plate body 3 and into the locking channel 15 of locking cartridge 10. With the locking pin 14 withdrawn from the central bore 5, the weight plate 1 is now easily added to or separated from a stack of weight plates that are held together by a lifting element (e.g., the center post represented by reference numeral 34 in FIGS. 3 and 4) that is removably received through the central bore 5. Thus, the user will be able to selectively control the total number of weight plates that are stacked together and carried by the lifting element 34 by adding or removing one or more weight plates to or from the stack to be lifted.

In the case where the weight plate 1 is added to the stack of weight plates to increase the total weight of the stack to be lifted, the switch control knob 16 is rotated to the locked position of FIG. 4. The toggle lever switch arm 20 is correspondingly rotated around swage pin 30, whereby the switch head 26 that is coupled to the locking pin 14 at bore 27 thereof applies a pushing force against the locking pin. The locking pin 14 is thusly caused to slide in an opposite direction through each of the axially-aligned locking channel 15 of locking cartridge housing 11 and the guide channel 17 of the plate body 3 so as to pass through the central bore 5 of plate body 3 at which to engage the lifting element 34.

One end of a (e.g., coil) spring 32, or the like, is connected to the lower arm member 22 of the toggle lever switch arm 20, and an opposite end of spring 32 is connected to the housing 11 of the locking cartridge 10. The spring 32 urges the switch arm 20 to either one of the unlocked or locked positions along the guide slot 18 so as to avoid an indefinite, intermediate position therebetween.

It may be appreciated that the toggle lever switch arm 20 that rotates within the housing 11 of the external locking cartridge 10 performs the function of a mechanical switch. That is to say, the switch control knob 16 is rotated between the unlocked (off) and locked (on) positions of FIGS. 3 and 4 so that the internal locking pin 14 is either withdrawn from or pushed through the central bore 5 of plate body 3 so as to be detached from or connected to the weight plate lifting element 34 within the central bore 5.

The external locking cartridge 10 of FIGS. 1-4 is shown lying entirely outside and flush against one side 9 of the weight plate body 3. In an alternate preferred embodiment, and referring now to FIGS. 5 and 6 of the drawings, a locking cartridge 10-1 is removably connected to the body 3-1 of a modified weight plate 1-1 at an internal locking cavity 40 that is recessed within the plate body 3-1 (best shown in FIG. 6). In this case, the body 11-1 of locking cartridge 10-1 has a stabilizer extension 42 projecting therefrom and sized for receipt within the locking cavity 40 to provide enhanced stability during use and prevent the locking cartridge 10-1 from shifting relative to the weight plate body 3-1.

Figure 5:
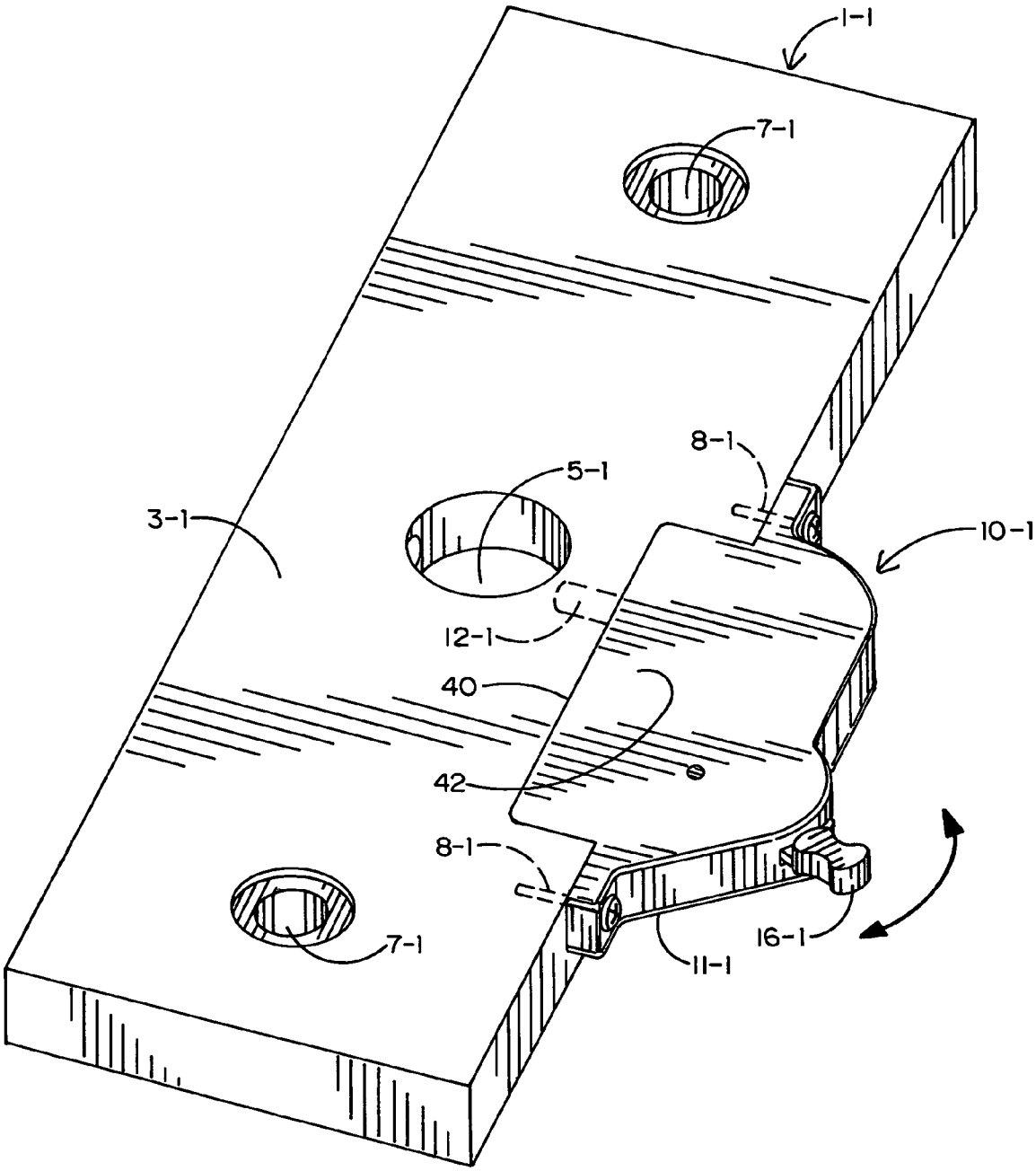
FIG. 5 shows a locking cartridge according to an alternate preferred embodiment detachably connected to a weight plate at an internal locking cavity formed therein.
Figure 6:
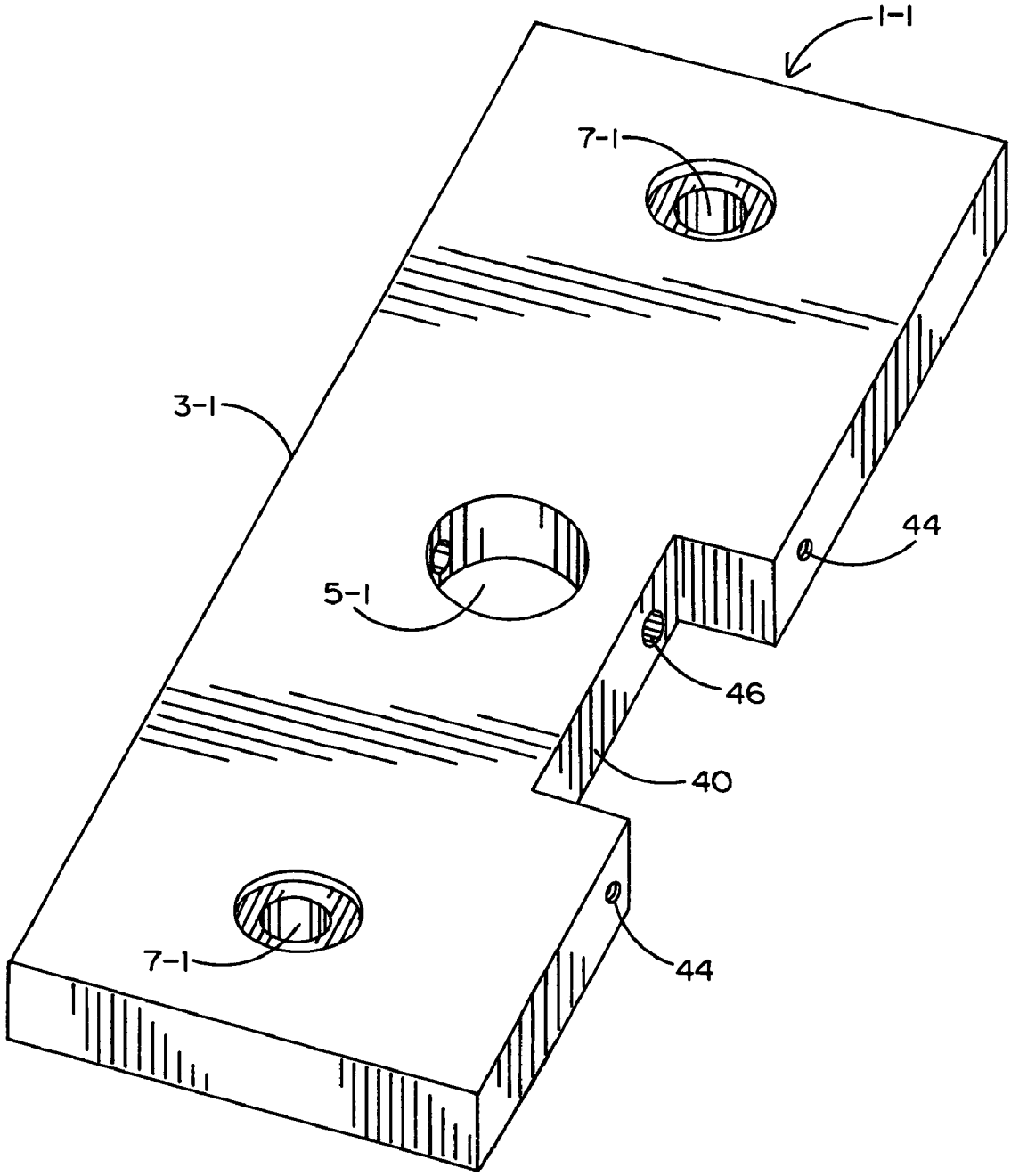
FIG. 6 shows one embodiment of the weight plate of FIG. 5.

Like the locking cartridge 10 of FIGS. 1-4, the locking cartridge 10-1 of FIGS. 5 and 6 include fasteners 8-1 which extend through outer ends of the housing 11-1 thereof for receipt by opposing holes 44 in the plate body 3-1. Likewise, an anchor stud 12-1 projects from the stabilizer extension 42 for receipt within an opposing stud hole 46 located at the locking cavity 40 of plate body 3-1. A switch control knob 16-1 is rotated (in the direction of the reference arrows of FIG. 5) to control the corresponding rotation of a toggle lever switch arm (not shown) and the reciprocal displacement of a locking pin (also not shown) within the housing 11-1 of locking cartridge 10-1 and the plate body 3-1 relative to a central bore 5-1 in a manner that is identical to that described when referring to the weight plate 1 of FIGS. 1-4. Accordingly, and like that previously described, the weight plate 1-1 can advantageously be added to or separated from a stack of weight plates by simply rotating the switch control knob 16-1 to either one of a locked (on) or unlocked (off) position.

The invention claimed is:

1. A weight plate to be releasably attached to a weight plate lifting element of physical fitness weight lifting equipment, said weight plate comprising:

a plate body having a hole formed therein for receipt of the weight plate lifting element;

an external locking cartridge located entirely outside said plate body, said locking cartridge detachably connected to one side of said plate body; and a locking pin sliding reciprocally through each of said external locking cartridge and said plate body so as to be displaced relative to the hole in said plate body, said external locking cartridge including a housing, a pivot located within said housing, and a pivotal lever switch arm that is connected to said pivot and coupled to said locking pin within said housing, said pivotal lever switch arm being surrounded by and projecting outside said housing at which to receive a force so that said pivotal lever switch arm rotates within said housing at said pivot and moves within said housing between an on position for causing said locking pin to slide in a first direction into the hole in said plate body at which to be attached to the weight plate lifting element and an off position for causing said locking pin to slide in an opposite direction out of the hole in said plate body so as to be detached from the weight plate lifting element.

2. The weight plate recited in claim 1, further comprising at least one removable fastener extending between the housing of said external locking cartridge and the one side of said plate body by which said locking cartridge is detachably connected to said plate body.

3. The weight plate recited in claim 1, wherein said external locking cartridge includes an anchor stud projecting therefrom and the one side of said weight plate body has a stud hole formed therein, said anchor stud being removably received within said stud hole to position said locking cartridge against said one side so as to enable said locking pin to slide reciprocally through said locking cartridge and said plate body in said first and opposite directions.

4. The weight plate recited in claim 1, wherein said locking pin is disposed in perpendicular alignment with the one side of said plate body, such that said locking pin slides reciprocally through said locking cartridge and said plate body in said first and opposite directions when the pivotal lever switch arm of said locking cartridge rotates within said locking cartridge housing between said on and off positions.

5. The weight plate recited in claim 1, further comprising a guide channel running through said plate body and communicating with said plate body hole and a locking channel running through the housing of said external locking cartridge and communicating with said guide channel, said guide channel and said locking channel lying in axial alignment with one another, and said locking pin sliding reciprocally in said first and opposite directions through said guide and locking channels relative to said weight plate hole.

6. The weight plate recited in claim 1, wherein said external locking cartridge also includes a spring connected between said locking cartridge housing and said pivotal lever switch arm for urging said switch arm to rotate at said pivot and move to one of said on or off positions.

7. The weight plate recited in claim 1, wherein said pivotal lever switch arm includes first and second arm members that are connected together at an interconnection therebetween so as to extend in perpendicular alignment with one another, said first arm member being manually accessible to receive a rotational force for causing said lever switch arm to rotate within said locking cartridge housing at said pivot between said on and off positions, and said second arm member being coupled to said locking pin, such that a rotation of said lever switch arm causes a corresponding linear displacement of said locking pin in said first and opposite directions relative to said plate body hole.

8. The weight plate recited in claim 7, wherein said locking pin has a bore formed therein, the second arm member of said pivotal lever switch arm being coupled to said locking pin within said bore.

9. The weight plate recited in claim 8, wherein the second arm member of said pivotal lever switch arm includes a relatively wide head received within the bore of said locking pin by which said second arm member is coupled to said locking pin.

10. The weight plate recited in claim 7, wherein said pivot includes a pivot pin extending through the interconnection between the first and second arm members of said pivotal lever switch arm, said pivot pin establishing a pivot axis within the housing of said external locking cartridge around which said lever switch arm rotates between said on and off positions.

11. A weight plate to be releasably attached to a weight plate lifting element of physical fitness weight lifting equipment, said weight plate comprising:

a plate body having a hole formed therein for receipt of the weight plate lifting element, a cavity formed in one side of said plate body, and a stud hole formed in said cavity;

a locking cartridge having a first portion lying flush against the one side of said plate body and a second portion received inwardly of the cavity in said one side, said locking cartridge also having an anchor stud projecting therefrom for receipt by the stud hole formed in the cavity of said plate body;

at least one fastener removably attached to the one side of said plate body by way of the first portion of said locking cartridge by which said locking cartridge is detachably connected to said plate body; and a locking pin disposed in perpendicular alignment with the one side of said plate body, said locking pin sliding reciprocally through each of said locking cartridge and said plate body so as to be displaced relative to the hole in said plate body, said locking cartridge including a pivot and a pivotal lever switch arm that is connected to said pivot and coupled to said locking pin within said detachable locking cartridge, said pivotal lever switch arm being surrounded by and projecting outside said locking cartridge at which to receive a force so that said pivotal lever switch arm rotates at said pivot and moves within said locking cartridge between an on position for causing said locking pin to slide in a first direction into the hole in said plate body at which to be attached to the weight plate lifting element and an off position for causing said locking pin to slide in an opposite direction out of the hole in said plate body so as to be detached from the weight plate lifting element.

12. The weight plate recited in claim 11, wherein said locking cartridge is detached from the plate body of said weight plate, whereby the second portion of said locking cartridge is removed from the cavity in said plate body and said anchor stud projecting from said locking cartridge is removed from the stud hole formed in said cavity when said one fastener is detached from said plate body.

* * * * *